US009372444B2

(12) United States Patent
Izawa et al.

(10) Patent No.: US 9,372,444 B2
(45) Date of Patent: Jun. 21, 2016

(54) WET TYPE DEVELOPING APPARATUS AND WET TYPE DEVELOPING METHOD

(75) Inventors: Hideo Izawa, Narashino (JP); Junichi Setoyama, Narashino (JP); Takao Namiki, Narashino (JP); Sumito Mera, Narashino (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 151 days.

(21) Appl. No.: 13/079,918

(22) Filed: Apr. 5, 2011

(65) Prior Publication Data

US 2011/0249990 A1 Oct. 13, 2011

(30) Foreign Application Priority Data

Apr. 8, 2010 (JP) ..... 2010-089214
Sep. 22, 2010 (JP) ..... 2010-212058

(51) Int. Cl.
*G03G 15/10* (2006.01)

(52) U.S. Cl.
CPC ..... *G03G 15/104* (2013.01)

(58) Field of Classification Search
CPC ..... G03G 15/10; G03G 15/104; G03G 2215/0658
USPC ..... 399/57, 233, 237–241, 248
See application file for complete search history.

(56) References Cited

U.S. PATENT DOCUMENTS 5,434,352 A * 7/1995 Miyazawa et al. ..... 399/240
2002/0152904 A1 10/2002 Ross et al.
2003/0167948 A1 9/2003 Weitz
2004/0005407 A1 * 1/2004 Takeuchi et al. ..... 427/240

(Continued)

FOREIGN PATENT DOCUMENTS

JP 2007-147977 A 6/2007
JP 2007225893 A * 9/2007

(Continued)

OTHER PUBLICATIONS

JP 2007225893 English translation Oda et al. Sep. 2007.*

(Continued)

*Primary Examiner* — David Gray
*Assistant Examiner* — Thomas Giampaolo, II
(74) *Attorney, Agent, or Firm* — Westerman, Hattori, Daniels & Adrian, LLP

(57) ABSTRACT

A wet type developing apparatus is provided which allows printing in a quality that is stable at an increased printing speed and also with changes in physical property of a liquid developer. The wet type developing apparatus to this end includes a liquid developer feed pathway which comprises a developing roller 7 for feeding the liquid developer onto a photoconductor drum 3; an anilox roller 9 immersed in part in the liquid developer and driven to rotate in rotational contact with the developing roller; and a doctor blade 11 disposed in contact with a surface of the anilox roller for controlling the rate of drawing up of the liquid developer. The developing and anilox rollers have their peripheral surfaces moving in an identical direction and at an identical rate of movement in an area of their rotational contact. A toner charger 12 is disposed opposite to a surface of the anilox roller downstream of an area of contact of the doctor blade with the anilox roller and upstream of an area of rotational contact of the anilox roller with the developing roller in a rotation direction of the anilox roller.

10 Claims, 7 Drawing Sheets

(56) References Cited

U.S. PATENT DOCUMENTS

| | | | | |
|---|---|---|---|---|
| 2004/0079246 | A1 | 4/2004 | Davis et al. | |
| 2005/0041997 | A1 * | 2/2005 | Kurotori et al. | 399/249 |
| 2007/0160391 | A1 * | 7/2007 | Takano et al. | 399/237 |
| 2008/0076052 | A1 * | 3/2008 | Nakamura et al. | 430/103 |
| 2008/0310870 | A1 * | 12/2008 | Berg et al. | 399/54 |
| 2010/0040387 | A1 * | 2/2010 | Hirai | 399/45 |

FOREIGN PATENT DOCUMENTS

| | | | |
|---|---|---|---|
| JP | 2008020763 | A * | 1/2008 |
| JP | 2008299065 | A * | 12/2008 |
| JP | 2009-192920 | A | 8/2009 |

OTHER PUBLICATIONS

JP 2008020763 English translation Kamijo et al. Jan. 2008.*

JP 2008299065 English translation Makii Dec. 2008.*

European Search Report dated Aug. 8, 2011, issued in corresponding European Patent Application No. 11160462.5.

* cited by examiner

WET TYPE DEVELOPING APPARATUS AND WET TYPE DEVELOPING METHOD

TECHNICAL FIELD

The present invention relates to a wet type developing apparatus for use in a wet type electrophotographic printer, in which an electrostatic latent image formed on a photoconductor drum is developed (or visualized) with a liquid developer, and to a wet type developing method for use with the apparatus.

BACKGROUND ART

In the wet type developing apparatus, an anilox roller (feed roller) immersed in part in a liquid developer is driven to rotate in rotational contact with a developing roller with which the photoconductor drum is driven to rotate in rotational contact, and the liquid developer is fed onto the developing roller via the anilox roller. With the developing roller driven to rotate in rotational contact with a photoconductor drum, an electrostatic latent image formed on the photoconductor drum is developed into a toner image. And, the toner image developed on the photoconductor drum is transferred onto a web of paper (recording medium).

In a conventional wet type developing apparatus of this sort, by voltage application from a power supply to the anilox roller, a voltage becoming a developing bias is applied to the developing roller. And, positive voltages as the bias voltages are applied from to the anilox roller and the developing roller. While the voltage is being controlled aptly, a thin film made of a uniform toner layer is formed on the developing roller and, with the toner of this thin film an electrostatic latent image on the photoconductor drum is developed in printing on a web of paper (see JP 2009-192920 A). The film thickness of the toner layer then on the surface of the developing roller exerts large influences on the print density and stability in print quality.

In the conventional wet type developing apparatus mentioned above, when the film thickness of the toner layer formed on the surface of the developing roller is controlled by changing the roller bias applied to the anilox roller, a small difference in electric potential between the developing roller the anilox roller to which the roller bias is applied gives rise to the problem that as the printing speed is increased or due to changes in physical property of the liquid developer, such inconveniences as a drop in image density, a deterioration in reproducibility of halftone dots, occurrence of streaks and unevenness and appearance of a trace of a cell of the surface of the anilox roller on the surface of an image, tend to be brought about, making it difficult to control so as to ensure print quality such as of print density, reproducibility of images and stability of the print quality in continuous printing.

Also, in order to keep the print quality from deteriorating due to such as a drop in density, there has been proposed an arrangement as shown in FIG. 5 of JP 2007-147977 A in which a compaction roller is driven to rotate in rotational contact with the periphery of the developing roller to compact the liquid developer (or to make it in the form of a thin film thereof) on the developing roller and further a cleaning roller is driven to rotate in rotational contact with the developer roller to effect cleaning of the developing roller. This arrangement has the problem, however, that mounting such compaction and cleaning rollers becomes a hindrance when the developing roller is exchanged, thereby worsening the apparatus maintainability.

When the compaction roller is used, the problem also arises that compaction tends to be uneven due to such as roller eccentricity, making it hard for the liquid developer to be filmed uniformly.

Also, in developing the latent image on the surface of the photoconductor drum driven to rotate in rotational contact with the developing roller, it is seen that the thinner the film thickness of the toner layer on the surface of the developing roller, the less the amount of the liquid developer that can be used and the more uniform the thickness of the thin film that can be made. Also, the lower the viscosity of the liquid developer, the more facile its toner agitation, and hence the lower the cost at which it can be manufactured, rendering it less expensive. In general, however, when the viscosity of the liquid developer is 100 mPa·s or less, the lower the toner density, the less dispersible the toner particles. From the fact, therefore, that if the film thickness of the toner layer formed on the surface of the developing roller is not more than 5 μm, the print density tends to be deficient, conventionally a toner layer having film thickness of 5-40 μm has been used for development, resulting in a large amount of use of the liquid developer.

On the other hand, in consideration of the above, the conventional use of a liquid developer that has a viscosity as high as 100-1000 mPa·s has presented the problem that it becomes difficult to agitate the toner, rendering its cost of manufacture in the apparatus exceedingly high.

The present invention has been made to solve the above-mentioned problems in the prior art. It is a first object of the present invention to provide a wet type developing apparatus for use in a wet type electrophotographic printer which allows printing in a stable quality at an increased printing speed and also with changes in physical property of a liquid developer, by making it possible to increase the difference in electric potential of toner particles on the surface of an anilox roller relative to a developing roller.

It is a second object of the present invention to provide a wet type developing apparatus which allows using a liquid developer low in viscosity and making thinner the film thickness of a toner layer formed on a surface of the developing roller to reduce the cost of the liquid developer, which with the film thickness on the surface of the developing roller made thinner, additionally allows forming the toner layer of a uniform thickness and reducing the amount of use of the liquid developer, which by increasing the difference in electric potential of toner particles on the surface of the developing roller, further allows developing an electrostatic latent image of a photoconductor roller at a high density to rise the high printing speediness by preventing the print quality from deteriorating due to such as a drop in density, which can also facilitate cleaning of residual toner on the surface of the developing roller to prevent the toner from caking on the developing roller, which also allows effecting maintenance of the developing and anilox rollers without hindrance by a cleaning roller, which further allows maintaining proper and constant the contact pressure of a cleaning blade in contact with the surface of the anilox, the developing or the cleaning roller simply by spring urging, and which additionally allows preventing the developing roller from being flexurally deformed.

It is a third object of the present invention to provide a wet type developing method which allows preventing the developing roller from flexural deformation by avoiding the developing roller and the photoconductor drum from contacting with each other in the state that they cease rotating and which allows conditioning rotation of the anilox and developing rollers before the developing roller comes into rotational contact with the photoconductor drum to maintain constant and uniform the density of an image being developed in a developing operation after the developing roller comes into rotational contact with the photoconductor drum.

DISCLOSURE OF THE INVENTION

In order to achieve the first object mentioned above, there is provided in accordance with the present invention in a first aspect thereof a wet type developing apparatus in which an electrostatic image formed by light exposure on a surface of a photoconductor drum is developed into a toner image with a liquid developer coated on a surface of a developing roller that is driven to rotate in rotational contact with the photoconductor drum, characterized in that the said wet type developing apparatus comprises: a feed pathway of the liquid developer that is constituted with the developing roller driven to rotate for feeding the liquid developer onto the photoconductor drum, and an anilox roller in part immersed in the liquid developer and driven to rotate in rotational contact with the developing roller wherein the developing and anilox rollers have their peripheral surfaces moving in an identical direction and at an identical rate of movement in an area of their rotational contact; a doctor blade disposed in contact with a surface of the anilox roller for controlling the rate of drawing up the liquid developer; and a toner charger opposite to a surface of the anilox roller downstream of an area of contact of the doctor blade with the anilox roller and upstream of an area of rotational contact of the anilox roller with the developing roller in a rotation direction of the anilox roller.

According to the makeup mentioned above of the invention, the toner charger opposite to a surface of the anilox roller in rotational contact with the developing roller for feeding the liquid developer onto the developing roller renders the electric potential of a toner particle on the anilox roller higher than of the developing roller, thereby facilitating electrical movement of toner particles on the anilox roller and increasing the accuracy of controlling the rate of their movement and, as a result, creating an unconventionally high stability in print density and quality while enhancing the ability to keep pace with high speed printing.

In addition, the liquid developer feed pathway that can simply be constituted with two rollers, the anilox and developing rollers, to feed the liquid developer from a tank onto the photoconductor drum allows a wet type developing apparatus to be manufactured at low cost and installed in a small space, thus achieving enhanced economical effects. Small and simple in makeup and easy to handle, the apparatus also attains improvements in effect of operability and maintenance.

In the makeup mentioned above of the invention, the apparatus according to the present invention may further includes a corona charger opposite to a surface of the developing roller downstream of the area of rotational contact of the developing roller with the anilox roller and upstream of an area of rotational contact of the developing roller with the photoconductor drum in a rotation direction of the developing roller. Further, the anilox roller used is preferably of helical type.

According to the makeup above, the corona charger disposed opposite to a surface of the developing roller downstream of the area of its rotational contact with the anilox roller and upstream of the area of its rotational contact with the photoconductor drum in the rotation direction of the developing roller allows electric charge to be imparted to toner particles in the liquid developer on the developing roller and the charged toner particles on the developing roller to flocculate or agglutinate, thereby developing an electrostatic latent image on the photoconductor drum with such flocculated and agglutinated toner particles. The ability to keep pace with high speed printing can thus be raised.

Also, the use as the anilox roller of that of helical type facilitates movement of toner particles on the surface of the anilox roller onto that of the developing roller. A combination of the anilox roller of helical type with a toner charger imparting electric charge to the surface of the anilox roller makes it possible to prevent unevenness from occurring in a printing image.

Though simple in makeup as mentioned above, the wet type developing apparatus according to the present invention makes it possible to produce print products that are free of unevenness in terms of density and image and stable in quality and to achieve functionally enhanced effects as well. Besides, there are less mechanical adjustment parts and it is easier to perform adjusting operations. Print quality is also ensured mainly through electrical adjustments and readily controllable.

In order to achieve the second object mentioned above, the present invention provides in a second aspect thereof a wet type developing apparatus in the first aspect thereof which further includes an upstream corona charger opposite to a surface of the developing roller downstream of the area of its rotational contact with the anilox roller and upstream of an area of its rotational contact with the photoconductor drum in a rotation direction of the developing roller, the upstream corona charger applying electric charges of a polarity such as to force toner particles onto the developing roller, the liquid developer having a viscosity ranging between 5 and 80 mPa·s, wherein the liquid developer fed onto the developing roller from the anilox roller is of a thin film having a film thickness ranging between 3 and 4.8 μm.

According to the preceding makeup of the invention, it is possible to use a liquid developer that is lower in viscosity, thereby reducing the cost of liquid developer and, rendering the toner layer on the developing roller thinner in film thickness with the result that the amount of use of liquid developer can be reduced and the film thickness can be made more uniform.

Also, applying electric charge by the toner charger to the surface of the anilox roller electrically charges the liquid developer stored to remain in recessed cells on the surface of the anilox roller, thereby raising its movability. The film thickness of the liquid developer on the surface of the developing roller is thus made more uniform.

Also, the upstream corona charger opposite to a surface of the developing roller downstream of the area of its rotational contact with the anilox roller and upstream of an area of its rotational contact with the photoconductor drum in a rotation direction of the developing roller to apply charges of a polarity such as to push toner particles on the developing roller allows the toner particles on the developing roller to flocculate or agglutinate, developing a latent image on the photoconductor drum with such flocculated and agglutinated toner particles. Thus, prints can be prevented from deteriorating in quality due to drops in density, and the ability to keep pace with high speed printing can be raised.

Also, the amount of liquid developer on the anilox roller that can be determined by the volume of grooves constituting the recessed cells can be made independent of the viscosity of liquid developer. The present invention allowed using a liquid developer having a viscosity as low as in a range between 5 and 80 mPa·s, which is easier to make. And, fed from the anilox roller onto the developing roller to form a layer thereon, the liquid developer having a layer or film thickness of 3 to 4.8 μm allowed printing of a quality that was stable and excellent in image density and image reproducibility in a printing operation in which a toner image developed on the developing roller was transferred from the photoconductor drum onto paper.

Also, preferably in the preceding makeup of the present invention, the anilox roller has recessed cells having a depth ranging between 24 and 30 μm, a toner charger is provided for applying charges to the surface of the anilox roller, the toner charger having a voltage set at 4 to 5.6 kV, and the anilox and developing rollers have a nip width ranging between 8 and 12 mm, whereby there is formed on the surface of the developing roller a thin film of the liquid developer having a film thickness ranging between 3 and 4.8 μm.

According to the preceding feature of the invention, it is possible to obtain a thin film of liquid developer having a film thickness in a range ranging between 3 and 4.8 μm.

The present invention also provides a wet type developing apparatus which in the makeup mentioned above includes further: a downstream corona charger opposite to a surface of the developing roller downstream in its rotation direction of an area of its rotational contact with the photoconductor drum, the downstream corona charger applying charges which are of a polarity opposite to that of charges applied by the upstream corona charger and which act on the toner particles to be apart from the developing roller; a cleaning roller driven to rotate in rotational contact with a surface of the developing roller downstream of an area of opposition of the developing roller to the downstream corona charger and upstream of an area of rotational contact of the developing roller with the anilox roller in a rotation direction of the developing roller for cleaning a surface of the developing roller; and a cleaning blade disposed in contact with a surface of the developing roller downstream in its rotation direction of an area of its rotational contact with the cleaning roller.

According to the preceding makeup of the invention, the downstream corona charger opposite to a surface of the developing roller after development downstream in its rotation direction of the area of its rotational contact with the photoconductor drum to apply charges which are of a polarity opposite to that of charges applied by the upstream corona charger to impart a force to toner particles that are flocculated or agglutinated to remain on the surface of the developing roller by the upstream corona charger, the force acting in a direction in which the toner particles come off the surface of the developing roller, thereby to facilitate taking off of the residual toner from the surface of the developer roller and making the residual toner difficult to remain on the developing roller. This in turn facilitates cleaning of the residual toner by the cleaning roller and blade, thereby preventing the residual toner particles from caking caused by their adhering on the developing roller surface.

The wet type developing apparatus according to the present invention preferably still further includes a developing unit supporting frame for supporting the developing roller and the anilox roller, the developing unit supporting frame being movable so that the developing roller comes into and out of contact with the photoconductor drum, and at least one of the developing roller and the anilox roller is movable into and out of contact with the other so as to make a nip width of these two rollers adjustable.

According to the preceding makeup of the invention, it is possible to separate the developing roller and the anilox roller (and also the cleaning roller if provided) in rotational contact therewith, together from the photoconductor drum simply by moving the developing unit supporting frame. This allows performing maintenance around the rollers in the developing unit at a site spaced apart from the photoconductor drum and bettering their maintainability.

Also, at non-printing time, it is possible to leave the developing and anilox rollers out of contact with each other. The developing roller whose surface layer is usually composed of rubber material can thereby be prevented from its flexural deformation caused if the developing roller in its non-rotating state remains in rotational, thus flexural contact with the anilox roller for a long period of time.

The wet type developing apparatus according to the present invention preferably yet further includes a cleaning roller supporting frame for supporting the cleaning roller, the cleaning roller supporting frame being supported by the said developing unit supporting frame being movable so that the cleaning roller comes into and out of contact with the developing roller.

According to this makeup of the invention, a cleaning roller supporting frame for supporting the cleaning roller is movable relative to the developing roller supporting frame, whereby the cleaning roller part can be made into a cassette which is removably mounted to the developing unit supporting frame. With the cleaning roller part removed from the developing unit supporting frame, wipe-off operation of a developing roller and its exchanging are facilitated. Thus, the maintainability of the wet type developing apparatus is raised.

Further, in the makeup above, each of the cleaning blade in contact with the developing roller and the cleaning blade in contact with the cleaning roller is preferably adapted to be contacted with a respective roller by a spring force adjustable of its urging force.

According to this makeup of the invention, the force of urging each cleaning blade to come in contact with the surface of a respective roller can be maintained proper and constant. This allows preventing or lightening wear and flawing of the roller by an excessive urging force of the blade, especially a developing roller composed of a rubber by the blade, and reducing the frequency of exchange of each roller, especially of a developing roller to raise its maintainability.

In order to achieve the third object mentioned above, there is also provided in accordance with the present invention in a third aspect thereof a wet type developing method in which an electrostatic latent image on the photoconductor drum is developed into a toner image by a wet type developing apparatus, which method comprises: in a downtime of development operation, disposing the developing roller spaced apart from the photoconductor drum, and in initiating a development operation, driving the anilox roller and the developing roller in rotational contact with the developing roller and the cleaning roller, respectively, for a time period of 2 to 20 seconds and thereafter making the developing roller come in rotational contact with the photoconductor drum.

According to the method mentioned above, disposing the photoconductor drum spaced apart from the developing roller in a downtime of development operation leaves the rollers when not rotating out of contact with each other and prevents the surface of the developing roller from its flexural deformation.

Also, in initiating a development operation, the anilox roller and the developing roller in rotational contact with the developing roller and the cleaning roller, respectively, can be driven in an idling state in the selected time, whereby there is maintained constant and uniform the density of development images in a developing operation initiated after the photoconductor drum comes into rotational contact with the developing roller.

BEST MODES FOR CARRYING OUT THE INVENTION

Figure 1:
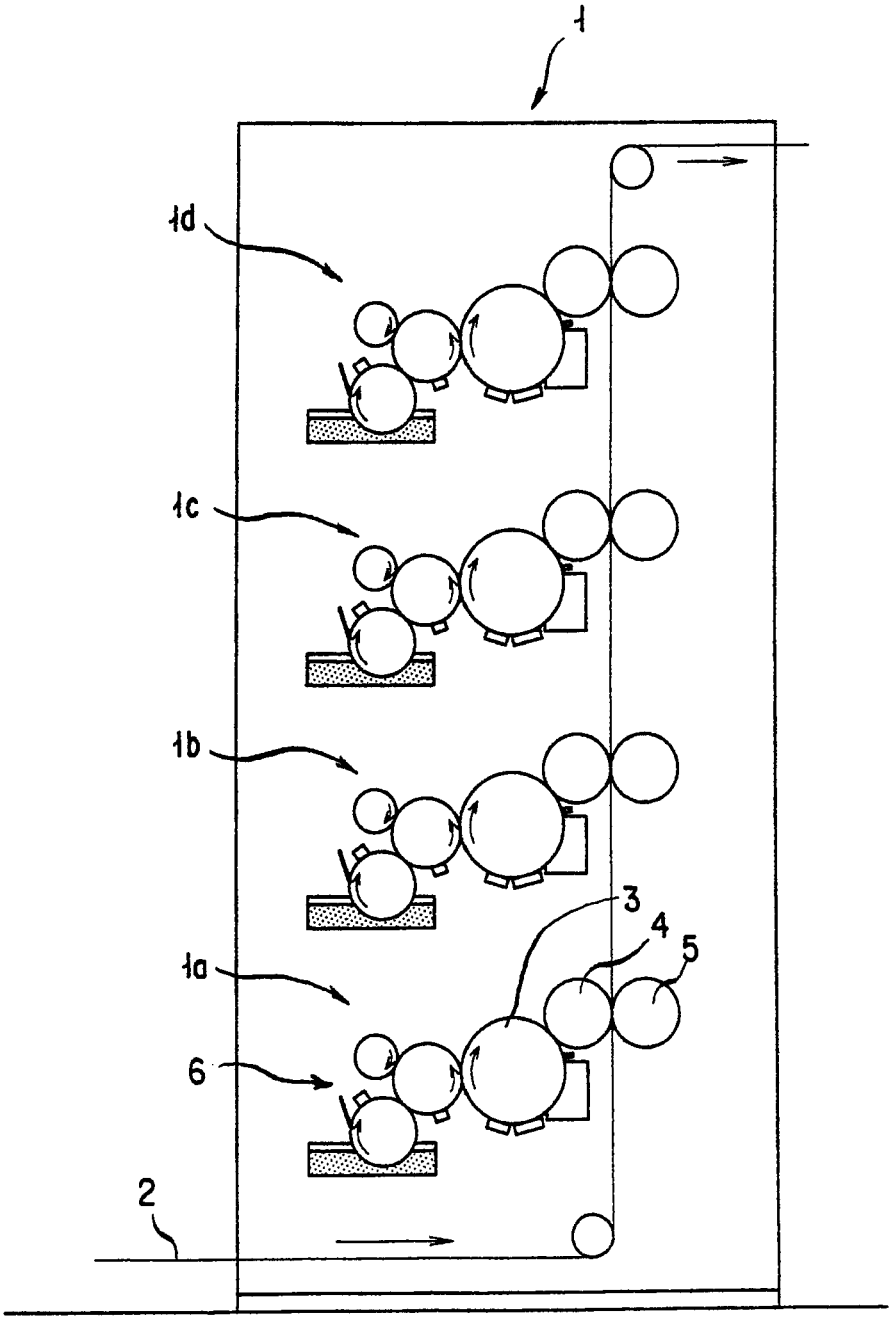
FIG. 1 is an explanatory view diagrammatically illustrating a wet type electrophotographic printing installation in which a plurality of wet type electrophotographic printers are longitudinally arranged each of which uses a wet type developing apparatus according to the present invention.
Figure 2:
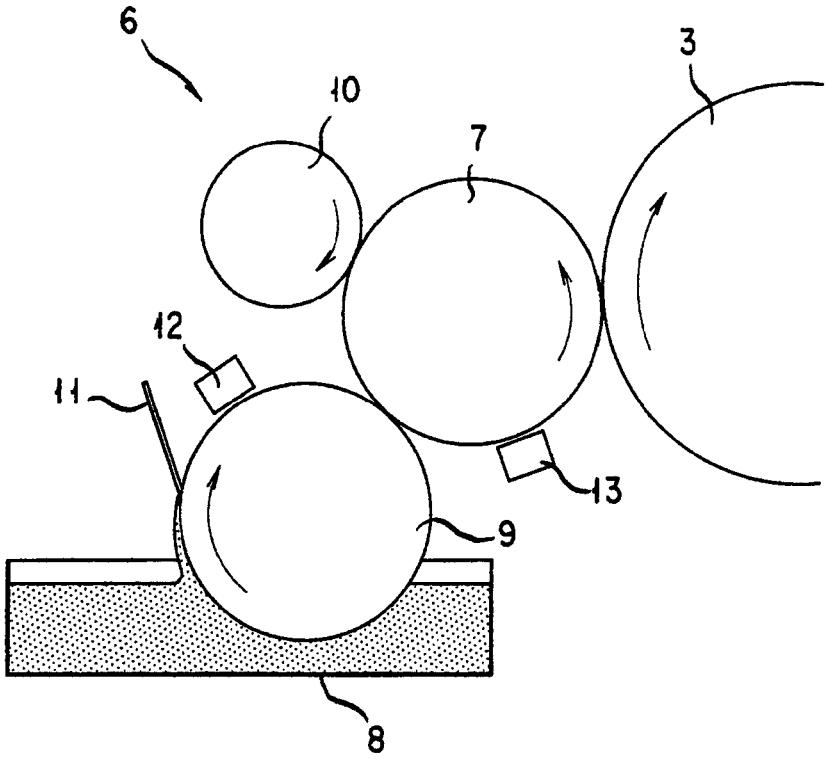
FIG. 2 is an explanatory view diagrammatically illustrating a first embodiment of the wet type developing apparatus according to the present invention.
Figure 3:
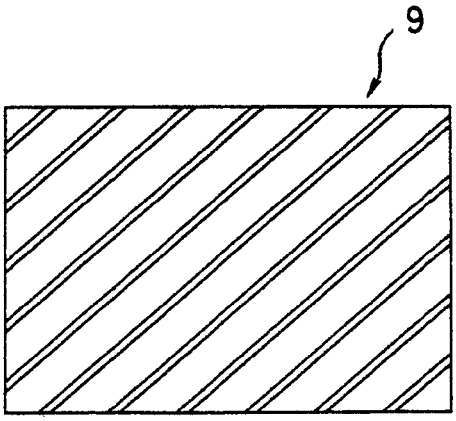
FIG. 3 is a development view of a surface of an anilox roller of helical type.

Mention is now made of a first embodiment of the present invention with reference to FIGS. 1 to 3.

FIG. 1 is a view showing a wet type electrophotographic printing installation or machine 1 in which a plurality of (four) wet type electrophotographic printers 1*a*, 1*b*, 1*c* and 1*d* are arranged vertically parallel to one another, each of which uses a wet type developing apparatus. In the electrophotographic printing installation 1, a continuous web of paper 2 is passed first through the wet type electrophotographic printer 1*a* at the lowermost side and then through the electrophotographic printers 1*b*, 1*c* and 1*d* in turn from the lower side to the upper side to effect multi-color printing.

Since the wet type electrophotographic printers 1*a*-1*d* are identically made up, mention will be made below of makeup of the lowermost wet type electrophotographic printer 1*a*.

In the Figure there are shown a photoconductor drum 3, a transfer roller 4 in rotational contact with the photoconductor drum 3 and a backup roller 5 which is turn in rotational contact with the transfer roller 4. The web of paper 2 passes through between the rollers 4 and 5. The wet type developing apparatus (which represents the first embodiment of the present invention) is designated at 6 including a developing roller in rotational contact with the photoconductor drum 3. In the wet developing apparatus 6, use is made of a liquid developer (liquid toner) having toner particles dispersed in a carrier liquid.

The photoconductor drum 3 in forming an image is rotationally driven in a direction of the arrow at a fixed speed of rotation by drive means such as a motor (not shown) while a surface of the photoconductor drum 3 is uniformly charged in the dark with a charging unit (not shown) in the meantime. Then, an original light figure when irradiated with an exposure unit (not shown) is imaged whereby an electrostatic latent image is formed on the surface of the photoconductor drum 3. Thereafter, the electrostatic latent image when it is passed through a region of development is visualized (or developed) by the wet type developing apparatus 6 to form a toner image on the surface of the photoconductor drum 3. And, after a portion of the carrier liquid as a component of the liquid developer is removed by a carrier liquid removing unit (not shown), the toner image formed on the surface of the photoconductor drum 3 is primarily transferred in a transfer region onto a surface of the transfer roller 4 by a bias charge applied through the transfer roller 4 and under a nip pressure between the rollers. The toner image primarily transferred onto the transfer roller 4 has an electric field imparted thereto for the toner image on the transfer roller 4 to be retained and not to be peeled off. And, the transfer image on the transfer roller 4 is secondarily transferred in a secondary transfer region onto the web of paper 2 by a bias charge applied through the backup roller 5 and under a nip pressure between the rollers.

The web of paper 2 having the toner image secondarily transferred thereon, and then fixed thereto by a fixing unit (dryer) not shown is led out of the machine as a printed matter on the one hand.

On the other hand, after the primary transfer, a residual potential that remains on the surface of the photoconductor drum 3 is removed by a static eliminator (not shown). And, a residual toner that has remained on the surface of the photoconductor drum 3 after the primary transfer is removed by a photoconductor cleaner (not shown) to make the photoconductor drum 3 ready for subsequent image forming.

FIG. 2 is an enlarged view showing the wet type developing apparatus 6 which as shown includes the developing roller 7 in rotational contact with the photoconductor drum 3, a tank 8 for accommodating the liquid developer, and an anilox roller (feed roller) 9 in part immersed in the liquid developer in the tank 8 and in rotational contact with the developing roller 7 to feed the developing roller 7 with the liquid developer in the tank 8. And, the liquid developer fed onto the developing roller 7 from the anilox roller 9 is fed onto the photoconductor drum 3 from the developing roller 7. Also, a developing roller cleaner 10 is in rotational contact with the developing roller 7. The anilox roller 9 is of helical type having helical projections on its surface as shown in FIG. 3.

In the wet type developing apparatus 6, the developing and anilox rollers 7 and 9 are so designed that their peripheral surfaces may move in an identical direction and at an identical rate of movement. Also, a doctor blade 11 has its tip in contact with a surface of the anilox roller 9 in part immersed in the liquid developer, upstream in its rotation direction of an area of its rotational contact with the developing roller 7, the doctor blade 11 serving to scrape off an excess of the liquid developer other than that in recessed cells made up on the surface of the anilox roller 9.

Also, there is provided a toner charger 12 that is opposite to a surface of the anilox roller 9 downstream of the area of its contact with the doctor blade 11 and upstream of the area of its rotational contact with the developing roller 7 in the rotation direction of the anilox roller 9, the toner charger 12 charging positively the toner particles in the liquid stored in the cells of the anilox roller 9 and trans-ported at a determined rate.

Further, there is a corona charger 13 that is opposite to a surface of the developing roller 7 upstream of the area of its rotational contact with the photoconductor drum 3 and downstream of the area of its rotational contact with the anilox roller 9 in the rotation direction of the developing roller 7, the corona charger 13 acting to charge the surface of the developing roller 7 so as to cause the toner particles moved onto the developing roller 7 from the anilox roller 9 to flocculate or agglutinate.

While the wet type developing apparatus according to the present invention has been illustrated to use the transfer roller 4 provided between the photoconductor drum 3 and the web of paper 2 for transferring a toner image on the surface of the photoconductor drum 3 onto the web of paper 2, it is a matter of course that without using the transfer roller 4, the surface of the photoconductor drum 3 may be disposed in rotational contact directly with the backup roller 5 to directly transfer a toner image on the surface of the photoconductor drum 3 onto the web of paper 2 passing between them.

In the makeup mentioned above, the liquid developer drawn up from the tank 8 and stored in the cells of the surface of the anilox roller 9 has an excessive amount thereof scraped off by the doctor blade 11 whereafter the liquid developer is charged positively by the toner charger 12 until it reaches where it is opposite to the developing roller 7. The positive potential of the toner particles in the liquid developer are thus enhanced.

The toner particles in the liquid developer on the surface of the anilox roller 9 are moved onto the surface of the developing roller 7 by rotational contact of the anilox roller 9 with the developing roller 7. Then, the toner particles in the state that they are flocculated or agglutinated with electric charges from the corona charger 13 opposite to the developing roller 7 are moved onto the surface of the photoconductor drum 3 in rotational contact with the developing roller 7 to form a toner image on the surface of the photoconductor drum 3.

Then, voltages as bias voltages are applied respectively to the photoconductor drum 3, the developing roller 7 and the anilox roller 9, e.g. a voltage around 50 V to the photoconductor drum 3, and a voltage of 300 to 350 V to each of the anilox roller 9 and the developing roller 9. Also, in charging by the toner charger 12 opposite to the anilox roller 9, voltage of 550 to 1000 V, preferably 550 to 650 V are applied thereto. Further, in charging by the corona charger 13 on the developing roller 7, a voltage of 1200 to 1800 V, preferably of 1500 V is applied thereto.

In what are mentioned above, in the absence of charging by the toner charger 12 onto the anilox roller, cohesions of the toner particles on the surface of the anilox roller 6 are weak, causing the toner particles to transfer unevenly onto the developing roller 7 and thus leading to a drop in print quality such as occurrence of uneven density and streaks as printing results. Also, increasing the applied voltage beyond 1000 V or excessively increasing the charging voltage to the toner particles tends to cause a drop of transferability of the toner particles onto the developing roller 7, giving rise to the problem that the same leads to a drop of density due to a drop in rate of transfer.

In the surface of the anilox roller 9, by imparting electric charges to the toner particles on the surface of the anilox roller 9 by the toner charger 12 to enhance electric charges of the toner particles on the anilox roller 9 while adjusting the output of the toner charger 12 and controlling the bias voltage to the anilox roller 9, electrical movement of the toner particles onto the developing roller 7 from the anilox roller 9 is facilitated; the toner particles are well transferred onto the developing roller 7 from the anilox roller 9. And, together with this, causing the toner particles to flocculate or agglutinate on the developing roller 7 by voltage application to the developing roller 7 with the corona charger 13 heightens the accuracy of controlling the amount of transfer of the toner particles onto the transfer roller 4 from the developing roller 7 to create an unconventionally high stability in print density and quality and to enhance the ability to keep pace with high speed printing.

Also, the form (pattern) of the cells on the surface of the anilox roller 9 may be of honeycomb or diamond type other than the helical type employed in the abovementioned embodiment in the present invention. While it has been confirmed that the form of the cells on the surface of the anilox roller 9 has an influence that may bring about streaks in an image developed, according to the test data by the present inventors it has also be confirmed that the combination of an anilox roller whose surface cell form is helical and a voltage application by a toner charger to the surface of the anilox roller is the optimum makeup to prevent streaks or unevenness from occurring into a printing image.

Mention is made of a second embodiment of the present invention with reference to the FIGS. 4 to 9.

Figure 4:
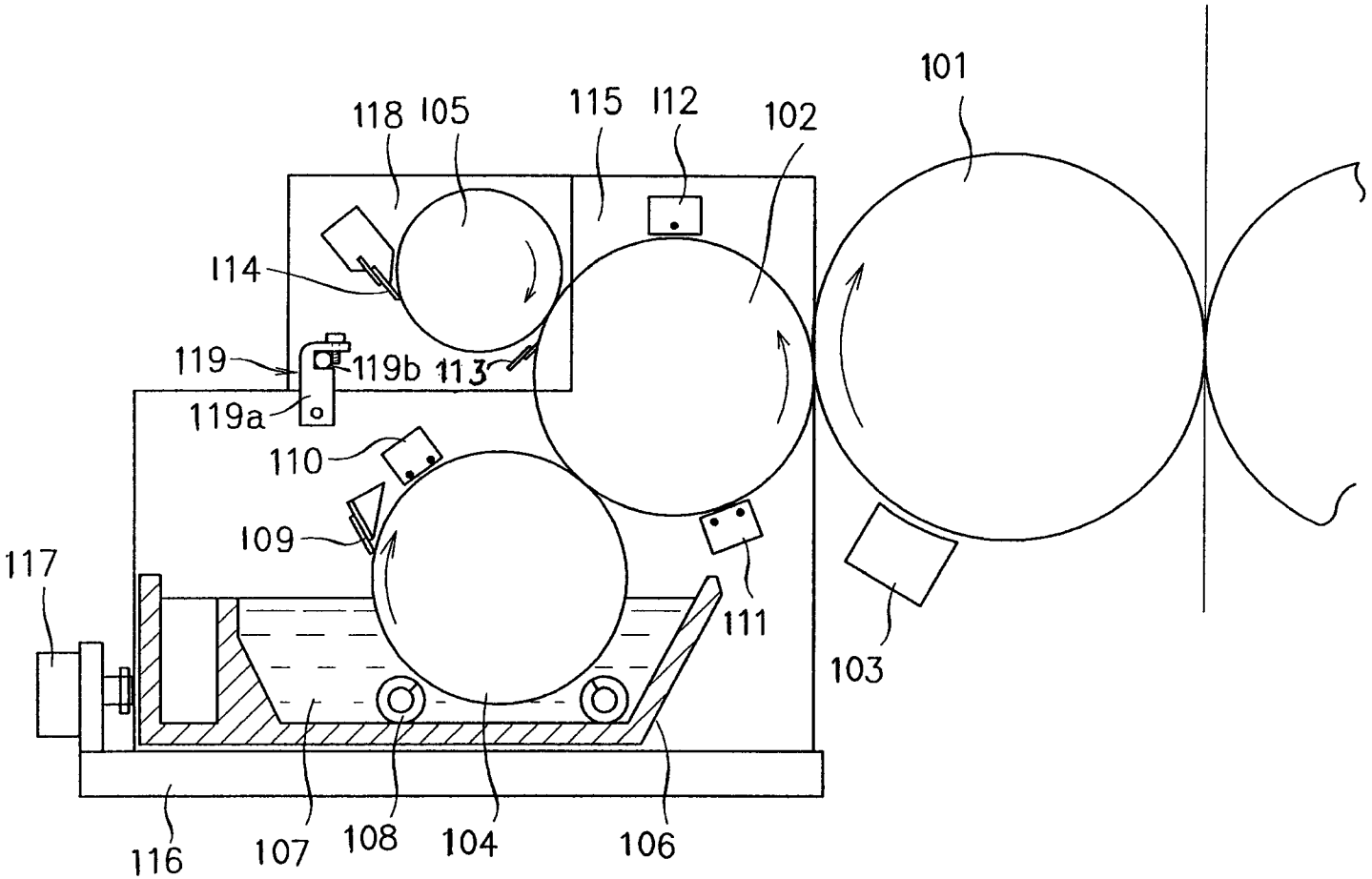
FIG. 4 is an explanatory view diagrammatically illustrating a second embodiment of the wet type developing apparatus according to the present invention.

In FIG. 4 there are shown a photoconductor drum 101; a developing roller 102 disposed in rotational contact with the photoconductor drum 101 for developing (visualizing) into a toner image an electrostatic latent image formed by light exposure with an exposure unit 103 onto a surface of the photoconductor drum 101; an anilox roller (liquid developer feed roller) 104 disposed in rotational contact with the developing roller 102 for feeding a liquid developer onto the developing roller 102; and a cleaning roller 105 disposed in rotational contact with the developing roller 102 for cleaning a surface thereof, these rollers if spaced apart from the photoconductor drum being independently driven synchronously to rotate in directions as indicated by the arrows so that in areas of their rotational contact their peripheral surfaces may move in an identical direction.

The anilox roller 104 is in part immersed in a liquid developer 107 stored in a liquid developer tank 106. The liquid developer 107 used may be one having a viscosity of 5-80 mPa·s. Supplied from a main tank (not shown) via a circuit (not shown), the liquid developer 107 is stored in the liquid developer tank 106 until it reaches a predetermined level in position. There is also shown an agitator 108 for agitating the liquid developer 107 within the liquid developer tank 106. The anilox roller 104 is provided with recessed cells which are in the form of thin helical grooves or fine halftone dots and which are stored with the liquid developer therein.

Also, a doctor blade 109 has its tip in contact with a surface of the anilox roller 104 at an area downstream in its rotation direction from an area of its immersion in the liquid developer 107 in the tank 106, the doctor blade 109 acting to scrape off an excess of the liquid developer other than portions thereof stored in the recessed cells made up on the surface of the anilox roller 10.

Also, there is provided a toner charger (corotron) 110 opposite to the surface of the anilox roller 104 downstream of the area of its contact with the doctor blade 109 and upstream of the area of its rotational contact with the developing roller 102 in the rotation direction of the anilox roller 104, the toner charger 110 charging positively toner particles in the liquid developer 107 stored in the cells of the anilox roller 104 and transferred at a determined rate.

There is provided an upstream corona charger (scorotron) 111 opposite to a surface of the developing roller 102 downstream of the area of its rotational contact with the anilox roller 104 and upstream of the area of its rotational contact with the photoconductor drum 101 in the rotation direction of the developing roller 102, the upstream corona charger 111 applying positive charges to the surface of the developing roller 102.

Also, there is provided a downstream corona charger (corotron) 112 opposite to a surface of the developing roller 102 downstream of the area of its rotational contact with the photoconductor drum 101 and upstream of an area of its rotational contact with the cleaning roller 105 in the rotation direction of the developing roller 102, the downstream corona charger 112 applying negative electric charges to the surface of the developing roller 102.

Further, there is provided a cleaning blade 113 disposed in contact with the developing roller 102 immediately downstream of the area of its rotational contact with the cleaning roller 105 in the rotation direction of the developing roller 102. And, a cleaning blade 114 is disposed in contact with the cleaning roller 105 downstream of the area of its rotational contact with the developing roller 102 in the rotational direction of the cleaning roller 105.

In the makeup mentioned above, the liquid developer drawn up from the liquid developer tank 106 by the rotation of the anilox roller 104 into the recessed cells of the anilox roller 104 has an excess thereof scraped off by the doctor blade 109. The liquid developer having its excess scraped off by the doctor blade 109 is charged with positive electric charges by the toner charger 110 while it is reaching the area of the rotational contact of the anilox roller 104 with the developing roller 102 to enhance positive charging of the toner particle therein.

The liquid developer stored in the recessed cells of the anilox roller 104 and containing the positive charge enhanced toner particles is moved onto the developing roller 102 by the rotational contact of the anilox roller 104 with the developing roller 102 to form a toner layer in the form of a thin film having a fixed thickness. The thickness of the toner layer formed on the surface of the developing roller 102 is determined by a depth of the recessed cells of the anilox roller 104, a voltage applied to the anilox roller 104 by the toner charger 110 and a value of nip width of the developing and anilox rollers 102 and 104 in rotational contact with each other. These values are set in the present invention so as to yield a film thickness of 3 to 4.8 μm of the toner layer of liquid developer formed on the surface of the developing roller 102.

In order to form the toner layer having a thickness of 3 to 4.8 μm on the surface of the developing roller 102 in this way, the form of the grooves of the anilox roller 104 is made honeycomb or helical type, the depth of the grooves having an optimum value of 30 μm and being in an allowable range between 4 and 30 μm.

Also, a voltage was applied by the toner charger 110 to the anilox roller 104, the voltage having an optimum value of 4.6 kV (output value of charger wire) and being in an allowable range between 4 and 5.6 kV (output value of charger wire).

Further, the nip width of the developing and anilox rollers 102 and 104 had an optimum value of 8 mm and was in an allowable range between 8 and 12 mm.

In measurements to determine that a toner layer formed on the surface of the developing roller 102 has a film thickness of 3 to 4.8 μm, a toner layer formed on the developing roller 102 is scraped off over a selected area and such a film thickness is converted into from the weight and specific gravity of an amount scraped off to have a measured value thereof.

Then, after forming the toner layer on the surface of the developing roller 102 according to the rotation of the developing roller 102, positive electric charge is applied to the toner layer from the upstream corona charger 111 opposite to the developing roller 102 and the toner particles charged positively in the toner layer becomes flocculated or agglutinated on the surface of the developing layer. And, the toner particles that become flocculated or agglutinated on the surface of the developing roller 102 are moved onto the photoconductor drum 101 to form a toner image on the surface of the photoconductor drum 101.

Negative electric charge from the downstream corona charger 112 as the developing roller 102 rotates is applied to a surface thereof downstream in its rotation direction of the area of its rotational contact with the photoconductor drum 101.

A residue of the toner that has acted to develop the electrostatic latent image on the photoconductor drum 101 is adhered to the developing roller 102 on a surface thereof downstream in its rotation direction of the area of its rotational contact with the photoconductor drum 101. As the developing roller 102 rotates, negative electric charge from the downstream corona charger 112 is applied to toner particles in this residual toner. With a negative potential opposite in polarity to the charge applied by the upstream corona charger 111, these toner particles lie under a force acting on them to part away from the surface of the developing roller 102.

With charges of 4 to 5.6 kV from the toner charger 110 as the output value of its charger wire applied to a surface of the anilox roller 104 in accordance with an embodiment of the present invention as mentioned above, toner particles in the liquid developer drawn up to a surface of the anilox roller 104 are charged and made better in movability, rendering the toner layer on the developing roller 102 thinner and even in film thickness.

In addition, with recessed cells of the anilox roller 104 made honeycomb or helical in shape and having a depth of 24 to 30 μm and with the anilox and developing rollers 104 and 102 made having a nip width of 8 to 12 mm, as mentioned above, it is possible to form a toner layer of 3 to 4.8 μm and uniform in its film thickness on the surface of the developing roller 102.

Next, the residual toner on the surface of the developing roller 102 is moved onto the cleaning roller 105 in rotational contact therewith downstream in its rotation direction and is thereby at least mostly cleaned off. Toner particles that may remain unmoved to the cleaning roller 105 are scraped off by the cleaning blade 113.

Meanwhile, the toner moved onto the cleaning roller 105 is scraped off by the cleaning blade 114.

In the absence of charging by the toner charger 110 to the anilox roller 104 mentioned above, the toner particles on the surface of the anilox roller 104 are weak in cohesion and unevenly movable onto the developing roller 102, leading to a deterioration in print quality such as with uneven print density and appearance of print streaks as printing results.

A positive voltage applied from the upstream corona charger 111 to the developing roller 102 allows the toner particles moved to and thus on the surface of the developing roller 102 to become flocculated and agglutinated thereon as mentioned above, raising the accuracy of controlling the rate of movement of the toner particles from the developing roller 102 onto the photoconductor drum 101, preventing deterioration of the print quality such as with drops in print density and enhancing the ability to keep pace with high speed printing.

A negative voltage applied to the surface of the developing roller 102 after development by the corona charger 112 disposed downstream in its rotary direction serves to impart a reverse polarity to particles flocculated and left on the surface of the developing roller 102 by the positive voltage applied by the corona charger 111 disposed upstream in its rotary direction, to give the particles the release force from the surface of the developing roller 102, and thereby renders residual toner particles on the surface of the developing roller 102 readily removable by the cleaning roller 105, thus making it possible to eliminate the possibility that the residual toner may, as coagulated, remain on the developing roller 102 and to prevent the residual toner from caking (coagulating) on the surface of the developing roller 102.

The thinner the film of a liquid developer (the toner layer) formed on the surface of the developing roller 102, the less can the amount of its use be and the easier to make the film that is uniform in thickness on the one hand. One the other hand, print with the film thickness not less than 5 μm tends to be deficient in print density. Also, in general a viscosity of liquid developer that is 100 mPa·s or less lowers the toner density and deteriorates dispersibility of toner particles so that it becomes difficult to make thinner the toner layer on the surface of the developing roller. Note further that the higher the viscosity of liquid developer, the harder to agitate the toner particles and hence the harder to make the liquid developer and the higher its cost. From the preceding, it has hitherto been thought desirable that the toner viscosity be as low as possible.

Applying electric charge from the toner charger 110 to the surface of the anilox roller 104 in accordance with the present invention betters fluidity of the liquid developer adhered on the surface of the anilox roller 104, making it possible to make the toner layer on the developing roller 102 uniform in film thickness and further to obtain such a thin film thickness of 3 to 4.8 μm that has hitherto been considered unattainable. Applying, subsequently, positive electric charge to the developing roller 102 by the corona charger 111 upstream of the area of its rotational contact with the photoconductor drum 101 to flocculate or agglutinate the toner particles on the surface of the developing roller 102 makes it possible to increase the toner density of a toner layer even if the liquid developer has a viscosity of 5 to 80 mPa·s that is lower than 100 mPa·s and, to make the film thickness uniform even if the toner layer on the surface of the developing roller 102 has a thinner limit film thickness of 3 to 4.8 μm which is the thinner limit, thereby obtaining a printed matter having a sufficient print density and without printing unevenness.

The wet type developing apparatus illustrated is shown to further include a developing unit supporting frame 115 for supporting the developing roller 102, the anilox roller 104 and the liquid developer tank 106, the frame 115 being supported on a base 116 so as to be movable to make the developing roller 102 come into and out of contact with the photoconductor drum 101, the movements being performed by telescopic operations of a cylinder unit 117 mounted on the base 116.

The cleaning roller 105 is supported by a cleaning roller supporting frame 118 which is supported by the developing unit supporting frame 115 so as to be movable to make the cleaning roller 105 come into and out of contact with the developing roller 102. The cleaning roller supporting frame 118 in the state that it has been moved to a position at which the cleaning roller 105 is in contact with the developing roller 102 is secured to the developing unit supporting frame by a uniting unit 119. In an exemplary makeup of the uniting unit 119, a hook 119*a* mounted rotatably to the developing unit supporting frame 115 is disposed in engagement with a pin 119*b* fixed to the cleaning roller supporting frame 118 to unite the frames 115 and 118.

Also in the wet type developing apparatus shown, the developing roller 102 is made movable into and out of contact with the anilox roller 104 so as to allow the nip width of the rollers 102 and 104 to be varied by varying an amount of such movements. Thus, in a downtime of printing operation in the state that the developing unit supporting frame 115 has been moved away from the photoconductor drum 101, the developing roller 102 can be moved away from the anilox roller 104.

Also, the cleaning roller 105 in the state that the cleaning roller supporting frame 118 is set to the developing unit supporting frame 115 can be moved away from the developing roller 102.

Figure 5:
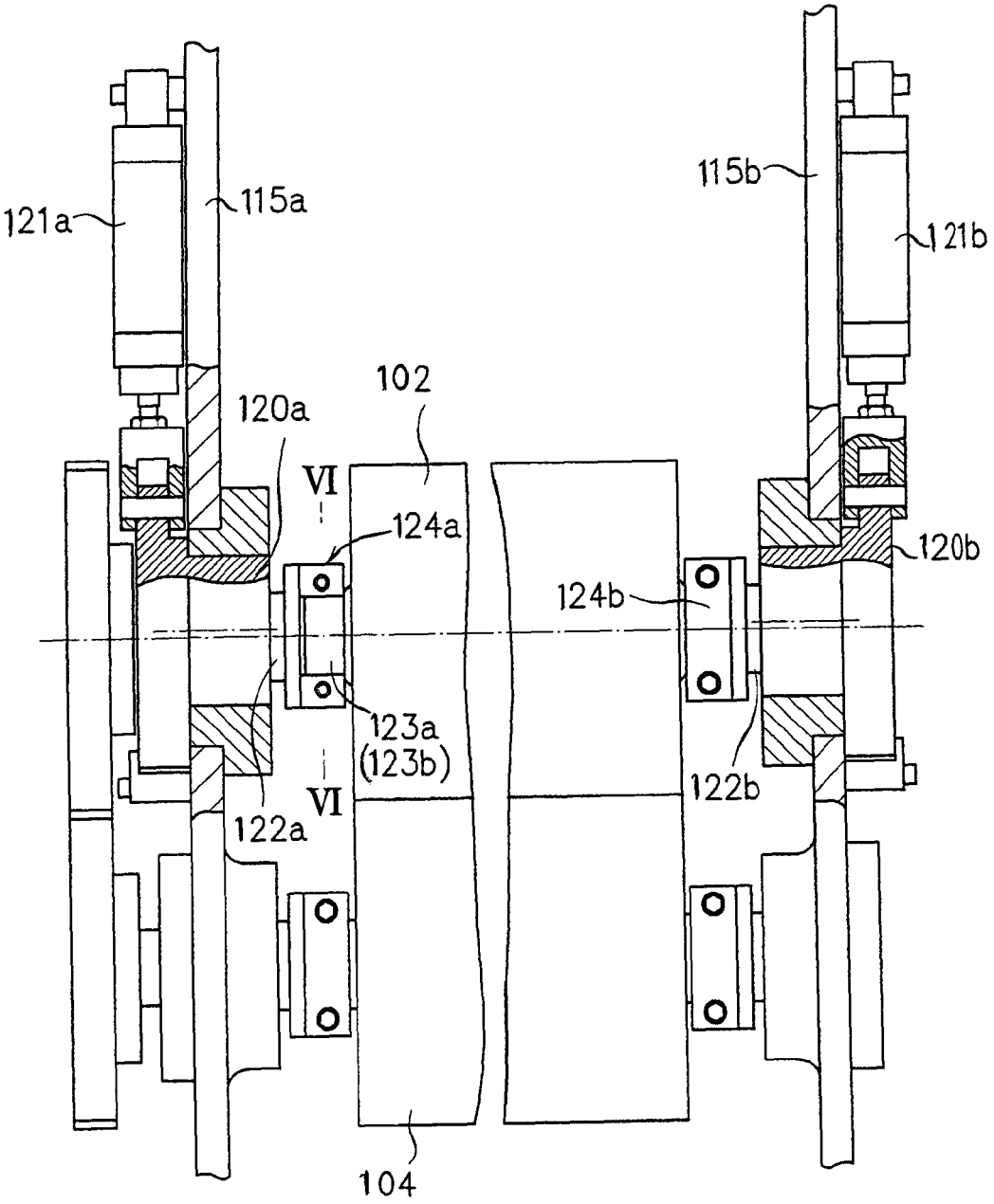
FIG. 5 is a sectional view in part broken illustrating an example of a bearing part of a developing roller.

FIG. 5 shows a bearing makeup for the developer roller 102 made movable into and out of contact with the anilox roller 104 in which shafts of the developing roller 102 at its axially both sides are received in eccentric bearings 120*a* and 120*b*, respectively. The eccentric bearings 120*a* and 120*b* are supported by developing unit supporting frame elements 115*a* and 115*b* at the axially both sides so that they can be rotated about an axis eccentric relative to that of the developing roller 102. These two eccentric bearings 120*a* and 120*b* are synchronously turned by telescoping cylinder units 121*a* and 121*b* synchronously operating at the axially both sides so that the developing roller 102 can be eccentrically rotated relative to the developing unit supporting frame 115 and its periphery moved into and out of contact with the periphery of the anilox roller 104.

Figure 6:
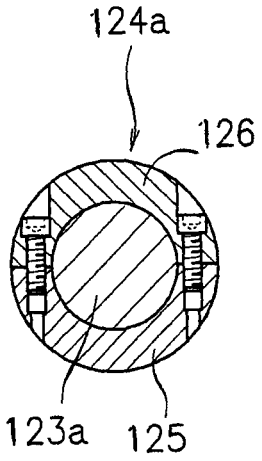
FIG. 6 is a sectional view of a part taken along the line VI-VI in FIG. 5.

Note further that: to enable the developing roller 102 to be easily detached from the eccentric bearings 120*a* and 120*b* supporting its axially both sides, the developing roller 102 is provided with roller end shafts 123*a* and 123*b* which are detachably coupled with supporting shafts 122*a* and 122*b* supported by the eccentric bearings 120*a* and 120*b* by shaft couplings 124*a* and 124*b* provided at the sides of the supporting shafts 122*a* and 122*b*. These shaft couplings 124*a* and 124*b* as shown in FIG. 6 is of a two-piece makeup in which the roller end shaft 123*a* is received in a coupling body 125 which is covered at its top with a lid member 126 so that the developing roller 102 can be detached orthogonally to axis by removing the lid member 126.

The anilox roller 104 has roller end shafts like the roller end shafts 123*a* and 123*b* for the developing roller 102, so that it can be coupled thereby to its supporting shafts received in like eccentric bearings.

With the assembly so made up, the developing and anilox rollers 102 and 104 supported by the developing unit supporting frame 115 via the bearings at their respective both ends are detachable without regard to the bearings at their respective both ends by disassembling the shaft coupling 124*a*, 124*b*. Removal and installation of the rollers can thus be easily done.

Note further that: the eccentric bearings 120*a* and 120*b* are one exemplary means for moving the developing roller 102 into and out of contact with the anilox roller 104. As means for moving the developing roller 102 orthogonally to axis, for example a linear slide unit may be used.

Figure 7:
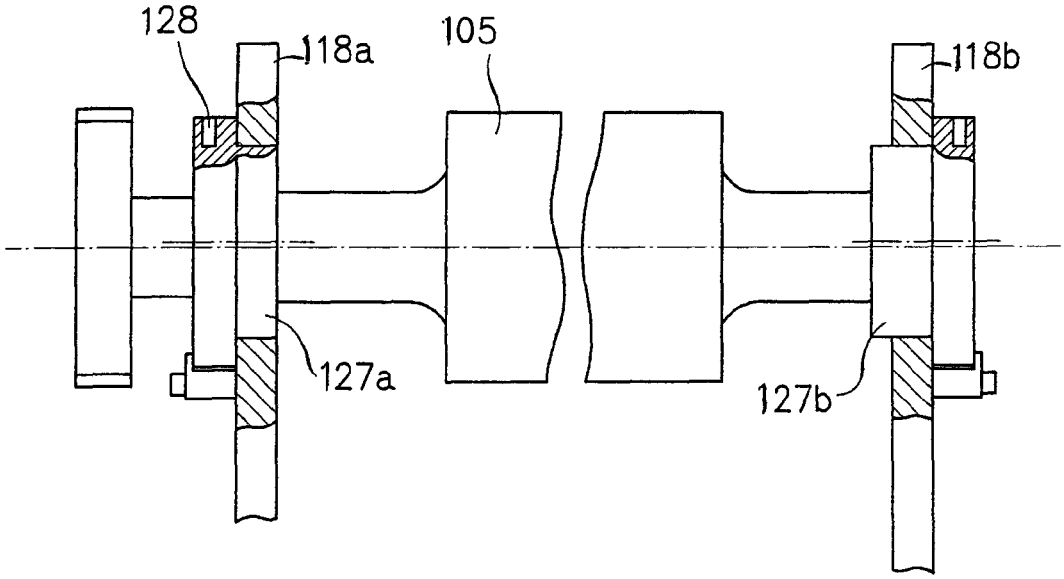
FIG. 7 is a sectional view in part broken illustrating a bearing part of the anilox roller.

FIG. 7 shows a support makeup for both ends of the cleaning roller 105. The cleaning roller 105 is received at its both ends with eccentric bearings 127*a* and 127*b* which are supported by the cleaning roller supporting frame 118, rotatably about an axis eccentric to the axis of the cleaning roller 105, so that rotation of the eccentric bearings 127*a* and 127*b* over a selected angle causes the cleaning roller 105 to move into and out of contact with the developing roller 102. The eccentric bearings 127*a*, 127*b* is rotated with a tool having one end inserted into a hole 128 which is formed on its peripheral surface.

In the makeup shown in FIG. 4, in making the doctor blade 109 in contact with the peripheral surface of the anilox roller 104, the cleaning blade 113 in contact with the peripheral surface of the developing roller 102 and the cleaning blade 114 in contact with the cleaning roller 105, a blade is contacted to a respective roller at a constant contact pressure by spring-urging. The contact pressure can be varied by adjusting the force of spring-urging.

Figure 8:
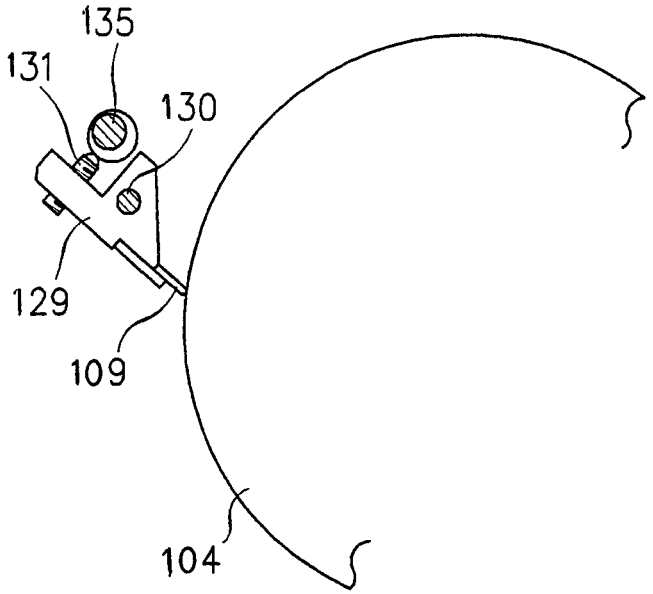
FIG. 8 is a side view illustrating a doctor blade.
Figure 9:
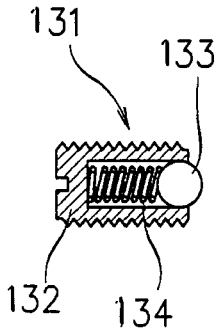
FIG. 9 is a sectional view illustrating a spring plunger.

To illustrate such a blade, reference is made to FIGS. 8 and 9 showing a supporting makeup of the doctor blade 109 in contact with the peripheral surface of the anilox roller 104.

The doctor blade 109 is attached to the tip of a bracket 129 which is pivoted on a pin 130 rotatably in a direction such that the tip of the doctor blade 109 may be moved into and out of contact with the anilox roller 104. The bracket 129 is spring-urged by a spring plunger 131 in a direction in which the tip of the blade 109 is moved into contact with the anilox roller 104.

The spring plunger 131 as shown in FIG. 9 has a ball 133 and a spring 134 which are received in a cylinder 132 whose outer periphery is threaded. The ball 133 is spring-urged in a direction in which it may project from the cylinder 132. And, the spring plunger 131 is screwed in the bracket 129 and the ball is held in contact with an eccentric cam 135 mounded to the frame side so that with the eccentric cam 135 turned, the ball 133 is displaced against the spring 134. The force of urging by the spring plunger 131 is thus adjusted. Note further that the force of urging by the spring plunger 131 can also be adjusted by adjusting the depth of screwing of the cylinder 132 into the bracket 129.

It should be noted further that the means usable for spring-urging the doctor blade against the anilox roller 104 is not limited to the spring plunger 131. It may alternatively be a torsion spring, a tension spring or the like whereby the bracket 129 to which the doctor blade 109 is attached can be spring-urged and turned in a direction in which the doctor blade 109 may come into and out of contact with the peripheral surface of the anilox roller 104.

What is claimed is:

1. A wet type developing apparatus in which an electrostatic image formed by light exposure on a surface of a photoconductor drum is developed into a toner image with a liquid developer coated on a surface of a developing roller that is driven to rotate in rotational contact with the photoconductor drum, characterized in that said wet type developing apparatus comprises:

a feed pathway of the liquid developer that is constituted with the developing roller driven to rotate for feeding the liquid developer onto the photoconductor drum, and an anilox roller having recessed cells on its surface, in part immersed in the liquid developer and driven to rotate in rotational contact with the developing roller wherein the developing and anilox rollers have their peripheral surfaces moving in an identical direction and at an identical rate of movement in an area of their rotational contact;

a doctor blade disposed in contact with the surface of the anilox roller for controlling the rate of drawing up the liquid developer; and a toner charger opposite to the surface of the anilox roller downstream of an area of contact of the doctor blade with the anilox roller and upstream of an area of rotational contact of the anilox roller with the developing roller in a rotation direction of the anilox roller, wherein electric charges of toner particles on the anilox roller are enhanced by adjusting an output of the toner charger and controlling a bias voltage to the anilox roller.

2. A wet type developing apparatus as set forth in claim 1, characterized in that it further includes a corona charger opposite to a surface of the developing roller downstream of an area of rotational contact of the developing roller with the anilox roller and upstream of an area of rotational contact of the developing roller with the photoconductor drum in a rotation direction of the developing roller.

3. A wet type developing apparatus as set forth in claim 1, characterized in that the anilox roller used is of helical type.

4. A wet type developing apparatus as set forth in claim 1, characterized in that it further includes an upstream corona charger opposite to a surface of the developing roller downstream of an area of rotational contact of the developing roller with the anilox roller and upstream of an area of rotational contact of the developing roller with the photoconductor drum in a rotation direction of the developing roller, the upstream corona charger applying charges of a polarity such as to force toner particles onto the developing roller, the liquid developer having a viscosity ranging between 5 and 80 mPa·s, wherein the liquid developer fed onto the developing roller from the anilox roller is of a thin film having a film thickness ranging between 3 and 4.8 μm.

5. A wet type developing apparatus as set forth in claim 4, characterized in that the anilox roller has recessed cells having a depth ranging between 24 and 30 μm, a toner charger is provided for applying charges to the surface of the anilox roller, the toner charger having a voltage set at 4 to 5.6 kV, and the anilox and developing rollers have a nip width ranging between 8 and 12 mm, whereby there is formed on the surface of the developing roller a thin film of the liquid developer having a film thickness ranging between 3 and 4.8 μm.

6. A wet type developing apparatus as set forth in claim 4, characterized in that it further includes:

a downstream corona charger opposite to a surface of the developing roller downstream in its rotation direction of an area of its rotational contact with the photoconductor drum, the downstream corona charger applying charges which are of a polarity opposite to that of charges applied by the upstream corona charger and which act on the toner particles to be apart from the developing roller;

a cleaning roller driven to rotate in rotational contact with a surface of the developing roller downstream of an area of opposition of the developing roller to the downstream corona charger and upstream of an area of rotational contact of the developing roller with the anilox roller in a rotation direction of the developing roller for cleaning a surface of the developing roller; and a cleaning blade disposed in contact with a surface of the developing roller downstream in a rotation direction of the developing roller of an area of rotational contact with the cleaning roller.

7. A wet type developing apparatus as set forth in claim 6, characterized in that it further includes a cleaning roller supporting frame for supporting the cleaning roller, the cleaning roller supporting frame being supported by said developing unit supporting frame and being movable so that the cleaning roller comes into and out of contact with the developing roller.

8. A wet type developing apparatus as set forth in claim 6, characterized in that it further includes a cleaning blade in contact with the cleaning roller, and each of the cleaning blade in contact with the developing roller and the cleaning blade in contact with the cleaning roller is adapted to be contacted with a respective roller by a spring force adjustable of its urging force.

9. A wet type developing method in which an electrostatic latent image on the photoconductor drum is developed into a toner image by a wet type developing apparatus as set forth in claim 6, characterized that it comprises:

in a downtime of development operation, disposing the developing roller spaced apart from the photoconductor drum, and in initiating a development operation, driving the anilox roller and the developing roller in rotational contact with the developing roller and the cleaning roller, respectively, for a time period of 2 to 20 seconds and thereafter making the developing roller come into rotational contact with the photoconductor drum.

10. A wet type developing apparatus as set forth in claim 4, characterized in that:

the apparatus further includes a developing unit supporting frame for supporting the developing roller and the anilox roller, the developing unit supporting frame being movable so that the developing roller comes into and out of contact with the photoconductor drum, and at least one of the developing roller and the anilox roller is movable into and out of contact with the other so as to make a nip width of these two rollers adjustable.

* * * * *